US010066842B2

(12) United States Patent
Nezu et al.

(10) Patent No.: US 10,066,842 B2
(45) Date of Patent: Sep. 4, 2018

(54) OUTDOOR UNIT OF AIR CONDITIONER

(71) Applicant: FUJITSU GENERAL LIMITED, Kawasaki-shi, Kanagawa-ken (JP)

(72) Inventors: Kenta Nezu, Kawasaki (JP); Satoshi Kasugai, Kawasaki (JP)

(73) Assignee: FUJITSU GENERAL LIMITED, Kawasaki-Shi, Kanagawa-Ken (JP)

( * ) Notice: Subject to any disclaimer, the term of this patent is extended or adjusted under 35 U.S.C. 154(b) by 0 days.

(21) Appl. No.: 15/423,211

(22) Filed: Feb. 2, 2017

(65) Prior Publication Data

US 2017/0248331 A1 Aug. 31, 2017

(30) Foreign Application Priority Data

Feb. 29, 2016 (JP) ..... 2016-037422

(51) Int. Cl.

| | |
|---|---|
| ***F25B 39/04*** | (2006.01) |
| ***F24F 1/50*** | (2011.01) |
| ***F24F 1/18*** | (2011.01) |
| ***F24F 1/46*** | (2011.01) |

(52) U.S. Cl.
CPC ..... *F24F 1/50* (2013.01); *F24F 1/18* (2013.01); *F24F 1/46* (2013.01)

(58) Field of Classification Search
CPC ..... F24F 1/50; F24F 1/18; F24F 1/46; F24F 1/06; F24F 1/48; F24F 13/20
See application file for complete search history.

(56) References Cited

U.S. PATENT DOCUMENTS

2009/0081940 A1* 3/2009 Jang ..... F24F 1/22 454/184

FOREIGN PATENT DOCUMENTS

| | | | |
|---|---|---|---|
| JP | 2000-240983 A | | 9/2000 |
| JP | 2008138951 A | * | 6/2008 |
| JP | 4894299 B2 | | 3/2012 |

OTHER PUBLICATIONS

Translation of JP 2008138951 A.*

* cited by examiner

*Primary Examiner* — Elizabeth Martin
(74) *Attorney, Agent, or Firm* — Manabu Kanesaka

(57) ABSTRACT

Provided is an outdoor unit of an air conditioner which has good assembly stability by more cheaply and easily increasing mechanical strength of a housing, and in which the cost thereof is further suppressed by reducing the number of components such as screws, as an outdoor unit of a large air conditioner including two blowers. The left front pillar and the right front pillar are fixed between the front beam and the base panel hung between the front ends of the left side panel and the right side panel, and the rear pillar is fixed between the rear beam and the base panel hung between the rear ends of the left side panel and the right side panel. Therefore, the front beam and the rear beam are prevented from being distorted or bent, and thus mechanical strength of the entire housing is enhanced.

7 Claims, 9 Drawing Sheets

OUTDOOR UNIT OF AIR CONDITIONER

RELATED APPLICATIONS

The present application is based on, and claims priority from, Japanese Application No. JP2016-037422 filed Feb. 29, 2016, the disclosure of which is hereby incorporated by reference herein in its entirety.

BACKGROUND OF THE INVENTION

1. Field of the Invention

The present invention relates to an outdoor unit of an air conditioner, more specifically, to an outdoor unit of an air conditioner in which a blower chamber is disposed above a machine chamber having a heat exchanger and a compressor.

2. Description of Related Art

As one air conditioner, there is a multi-type air conditioner in which a plurality of indoor units are connected to one outdoor unit. For example, as described in Japanese Patent No. 4894299, an outdoor unit of a multi-type air conditioner includes a vertically rectangular parallelepiped housing provided with a rectangular base plate, a pair of side plates vertically disposed and fixed to both left and right ends of the base plate, a front plate vertically disposed and fixed to a front end of the bottom plate, a rear plate vertically disposed and fixed to a rear end of the base plate, and a top plate closing a top surface.

In this type of an outdoor unit, an interior of the housing is partitioned into a machine chamber having a heat exchanger and a compressor at a lower portion and a blower chamber having a blower at an upper portion, with a plane including a front beam and a rear beam as a boundary, and the blower is supported by the front beam and the rear beam in the blower chamber.

An air blowing port of the blower is disposed on a top surface of the housing, and an interior of the machine chamber becomes a negative pressure space as the blower rotates, and air passed through the heat exchanger from an outer circumference of the housing and entered the machine chamber passes through the blower chamber and is discharged from the upper portion of the housing to the outside of the housing. Therefore, heat exchange between the air and the refrigerant is performed.

In addition, as an example of an outdoor unit of a higher output multi-type air conditioner, there is an outdoor unit in which a large heat exchanger and two blowers are incorporated in a housing. In order to incorporate the two blowers in the housing, the outdoor unit has the housing with a horizontally elongated rectangular parallelepiped shape, and two blowers are disposed side by side in a right and left between a front beam and a rear beam in an interior thereof (for example, refer to Japanese Patent No. 2000-240983).

However, when the housing is designed to have a horizontally elongated shape and two blowers are attached side by side between the front beam and the rear beam, a large bending moment may be applied to a center of the front beam and the rear beam, and thus there is a possibility of being distorted or bent.

If the front beam and the rear beam are distorted or bent, it is not preferable because there is a possibility of hindering the assembly of panels and the like. Therefore, it is desirable to increase mechanical strength by increasing the number of beam members and supports or the plate thickness for reinforcement, but it cannot avoid an increase in the cost related to this reinforcement.

SUMMARY OF THE INVENTION

Therefore, an object of the present invention is to provide an outdoor unit of an air conditioner which has good assembly stability by more cheaply and easily increasing mechanical strength of a housing, and in which the cost thereof is further suppressed by reducing the number of components such as screws, as an outdoor unit of a large air conditioner including two blowers.

An outdoor unit of an air conditioner according to an aspect of the present invention includes a housing that includes a base panel, a left side panel and a right side panel disposed along a left side end and a right side end of the base panel, a front beam hung between front ends of the left side panel and the right side panel, and a rear beam hung between rear ends of the left side panel and the right side panel. An interior of the housing is partitioned into a machine chamber having a heat exchanger and a compressor at a lower portion and a blower chamber having a blower at an upper portion, with a plane including the front beam and the rear beam as a boundary. A first blower and a second blower are supported side by side by the front beam and the rear beam in the blower chamber, and an air blowing port of the blower is disposed on a top surface of the housing. A front pillar for supporting an intermediate portion of the front beam is disposed between the front end of the base panel and the front beam and a rear pillar for supporting an intermediate portion of the rear beam is disposed between the rear end of the base panel and the rear beam.

As a more preferred aspect, the heat exchanger includes a first heat exchanger and a second heat exchanger, a lower space on the first blower side is defined as a left machine chamber and a lower space on the second blower side is defined as a right machine chamber among the machine chambers, the first heat exchanger is disposed in the left machine chamber, the second heat exchanger is disposed in the right machine chamber, and the front pillar includes a left front pillar disposed on a front surface of the left machine chamber and a right front pillar disposed on a front surface of the right machine chamber.

As a further preferred aspect, the rear pillar is disposed at a position to close the rear opening portion existing between a rear end portion of the first heat exchanger and a rear end portion of the second heat exchanger.

As another aspect, a left end of the left front pillar is fixed along the front end of the left side panel and a right end of the right front pillar is fixed along the front end of the right side panel.

As further another aspect, the first heat exchanger and the second heat exchanger are respectively formed in a U-shape, and end portions of the first heat exchanger and the second heat exchanger are disposed so as to face each other, the left side panel is formed between a pair of post portions engaged with each corner portion of the left end of the base panel and the post portions, and is provided with a side suction grille for exposing a side portion of the first heat exchanger to the outside of the housing, and the right side panel is formed between a pair of post portions engaged with each corner portion of the right end of the base panel and the post portions, and is provided with a side suction grille for exposing a side portion of the second heat exchanger to the outside of the housing.

In addition, a front suction grille for exposing a front surface side of the first heat exchanger to the outside of the housing may be integrally formed in the left front pillar, and a front suction grille for exposing a front surface side of the second heat exchanger to the outside of the housing may be integrally formed in the right front pillar.

Furthermore, a front opening portion for maintenance exists between the left front pillar and the right front pillar, and a service panel for closing the front opening portion may be disposed between the left front pillar and the right front pillar.

According to the aspect of the present invention, it is possible to enhance the mechanical strength of the entire housing. In addition, screws used for fixing are reduced, and cost reduction and assembling performance can be improved.

DESCRIPTION OF EMBODIMENTS

Next, although an outdoor unit of an air conditioner of the present invention will be described with reference to drawings, the present invention is not limited thereto.

As illustrated in FIGS. 1 to 4, an outdoor unit 1 of an air conditioner includes a rectangular parallelepiped housing 2 horizontally elongated in a lateral direction (lateral direction in FIG. 1), and an interior of the housing 2 is partitioned into a machine chamber MC having a heat exchanger 3 and a compressor (not illustrated), and a blower chamber FC having a blower 4. In the embodiment, the machine chamber MC is disposed at a lower portion in the housing 2, and the blower chamber FC is disposed above the machine chamber MC.

Figure 1:
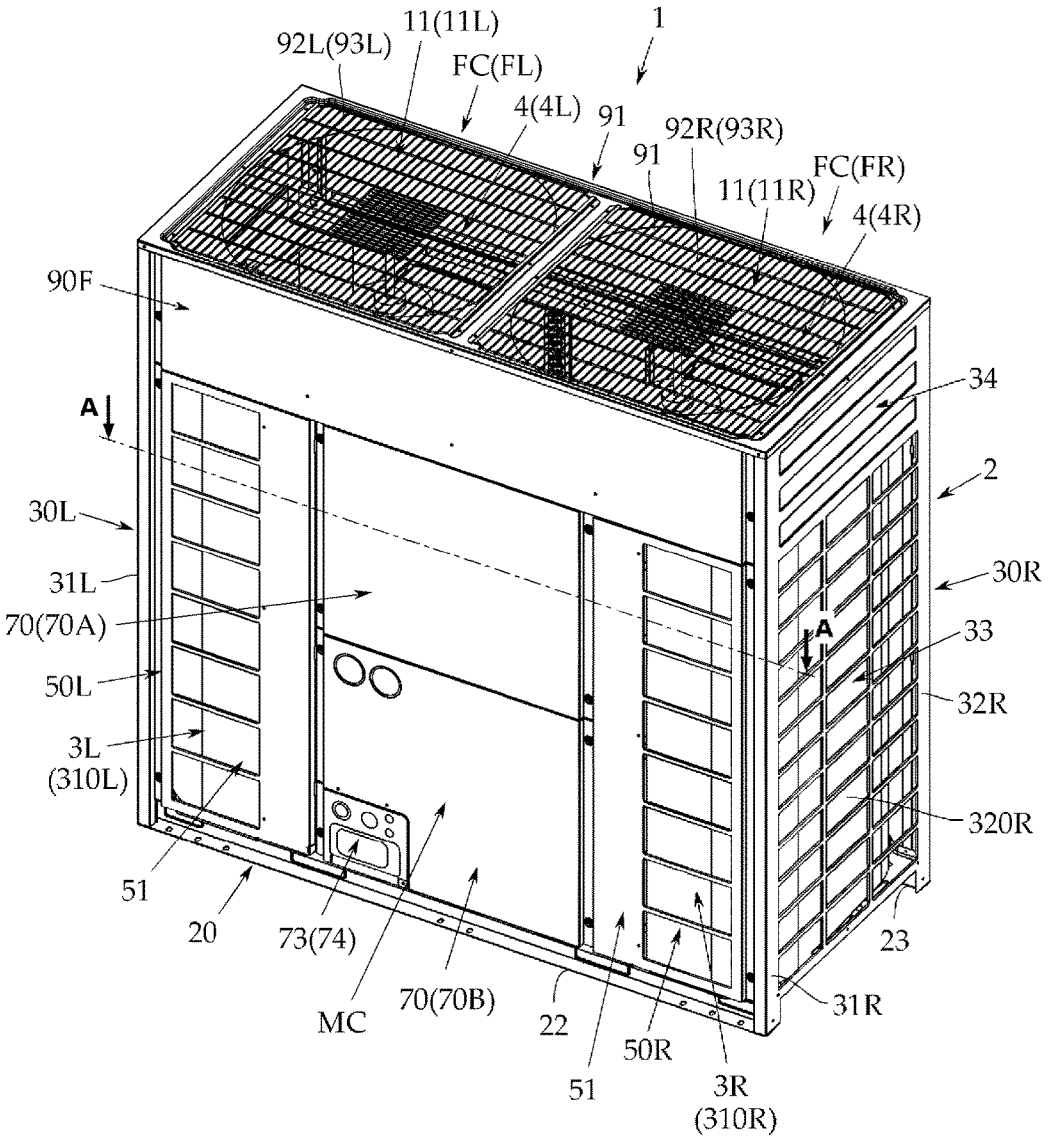
FIG. 1 is an external perspective view of a front surface side of an outdoor unit of an air conditioner according to an embodiment of the present invention.

When viewing the lateral direction of the housing 2 in front surface in FIG. 1, a left half space of the machine chamber MC is defined as a left machine chamber ML, a right half space thereof is defined as a right machine chamber MR, a left half space of the blower chamber FC is defined as a left blower chamber FL, and a right half space of the blower chamber FC is defined as a right blower chamber FR, a first heat exchanger 3L is disposed in the left machine chamber ML of the housing 2, and a second heat exchanger 3R is disposed in the right machine chamber MR.

In addition, a first blower 4L is disposed in the left blower chamber FL, a second blower 4R is disposed in the right blower chamber FR. A first air blowing port 11L of the first blower 4L and a second air blowing port 11R of the second blower 4R are respectively disposed on an upper surface of the housing 2.

The housing 2 is provided with a rectangular base panel 20 installed on the surface to be installed, a left side panel 30L vertically disposed at a left side end of the base panel 20, a right side panel 30R vertically disposed at a right side end of the base panel 20, a front beam 40F (refer to FIG. 4) hung horizontally between a front end of the left side panel 30L and a front end of the right side panel 30R, and a rear beam 40R (refer to FIG. 4) hung horizontally between a rear end of the left side panel 30L and a rear end of the right side panel 30R, as a basic structure.

Figure 5:
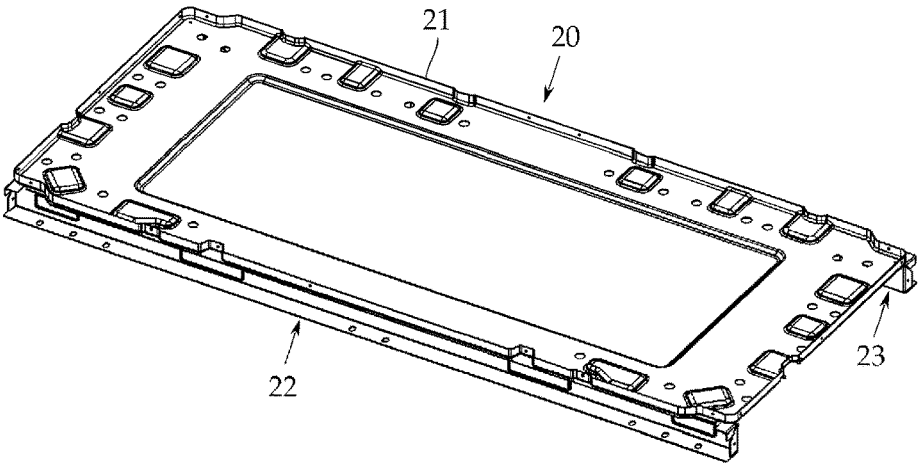
FIG. 5 is a perspective view of the base panel.

As illustrated in FIG. 5, the base panel 20 is formed by pressing or welding a steel plate, and is formed in a horizontally elongated rectangular shape. An engagement portion 21 in which a panel is screwed to the circumferential edge of the base panel 20 is substantially vertically disposed over the entire circumference.

On the base panel 20, a front leg 22 and a rear leg 23 are formed when the outdoor unit 1 is installed on a surface to be installed (not illustrated). The front leg 22 is bent substantially at right angle from a front end side (front side in FIG. 5) toward the lower side of the base panel 20, and is formed continuously over the right and left. The rear leg 23 is bent substantially at right angle from a rear end side (rear side in FIG. 5) toward the lower side of the base panel 20, and is formed continuously over both the right and left ends.

Figure 3:
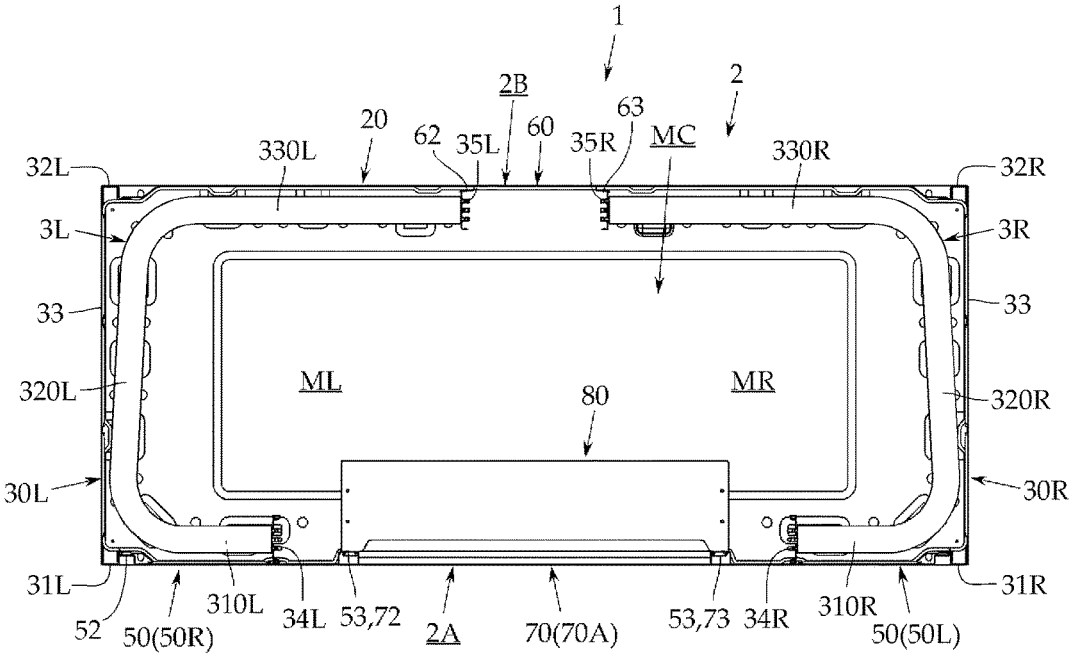
FIG. 3 is a cross-sectional view taken along line A-A of FIG. 1.

Referring to FIG. 3 together, the heat exchanger 3 includes two heat exchanger units of a first heat exchanger 3L and a second heat exchanger 3R. The first heat exchanger 3L includes a left front portion 310L disposed along a left front end of the base panel 20, a left side portion 320L disposed along the left side end of the base panel 20, and a left rear portion 330L disposed along a left rear end of the base panel 20, and is formed in a U-shape in a top view (paper direction in FIG. 3).

The first heat exchanger 3L is fixed to the base panel 20 via a first end plate 34L attached to a front end portion of the left front portion 310L, and a second end plate 35L attached to a rear end portion of the left rear portion 330L.

The second heat exchanger 3R includes a right front portion 310R disposed along a right front end of the base panel 20, a right side portion 320R disposed along the right side end of the base panel 20, and a right rear portion 330R disposed along a right rear end of the base panel 20, and is formed in a U-shape in a top view (paper direction in FIG. 3).

The second heat exchanger 3R is fixed to the base panel 20 via a front end plate 34R attached to the front end portion of the right front portion 310R, and a rear end plate 35R attached to the rear end portion of the right rear portion 330R.

Figure 6A:
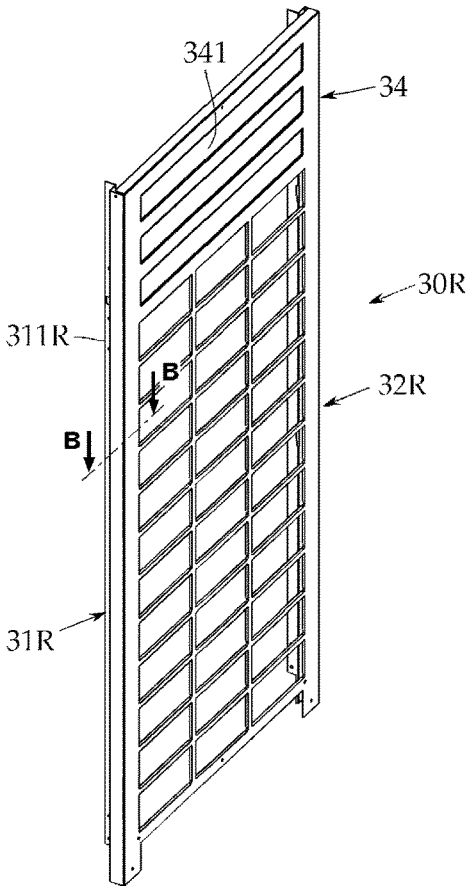
FIG. 6A is a perspective view of a front surface side of the side panel.
Figure 6B:
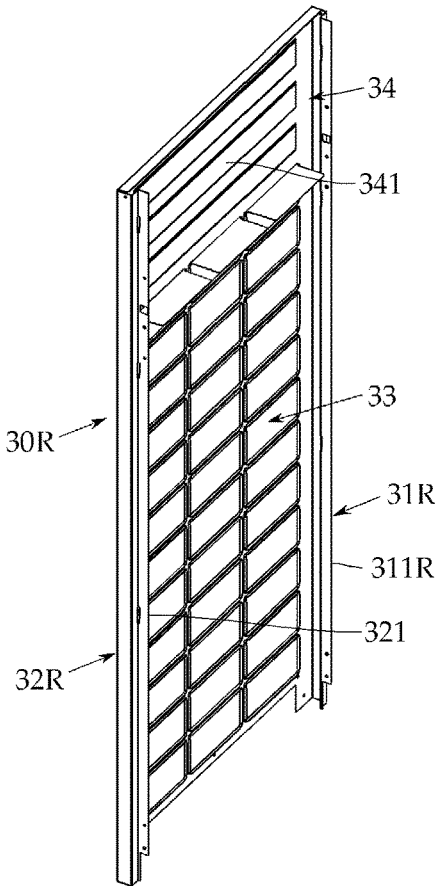
FIG. 6B is a perspective view of a rear surface side of the side panel.

Next, referring to FIGS. 6A, 6B, and 7, although a configuration of the left side panel 30L and the right side panel 30R will be described, since basic shapes of the left side panel 30L and the right side panel 30R are the same as each other, and these panels are symmetrically disposed, hereinafter, a configuration of the right side panel 30R will be described.

In the embodiment, the right side panel 30R includes a press-formed metal plate. The width of the right side panel 30R is substantially the same as the length of a right end of the base panel 20, and is formed in a vertically elongated rectangular shape extending from a lower end to an upper end of the housing 2.

Figure 2:
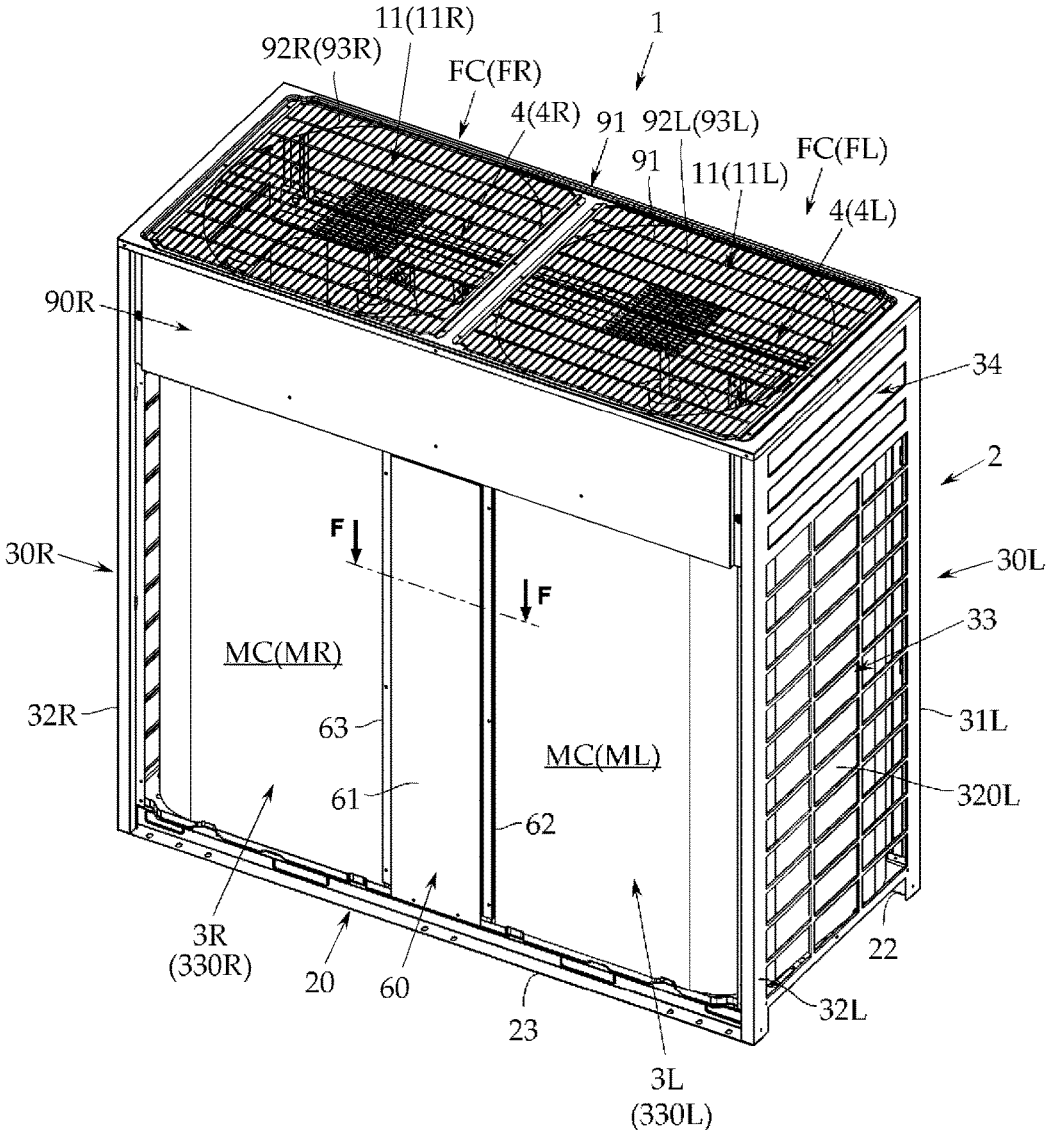
FIG. 2 is an external perspective view of a rear surface side of the outdoor unit of an air conditioner.

The right side panel 30R protects a pair of post portions 31R and 32R engaged with corner portions of the base panel 20 and the right side portion 320R of the second heat exchanger 3R, and is provided with a grille portion 33 as a side suction grille and a panel portion 34 for closing the right side surface of the blower chamber FC in FIG. 2.

Figure 7:
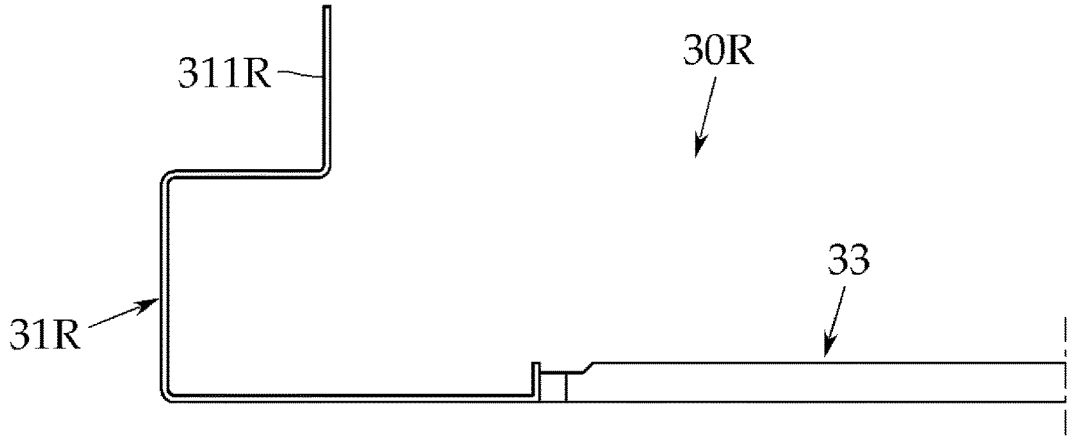
FIG. 7 is a cross-sectional view taken along line B-B of FIG. 6A.

As illustrated in FIG. 7, the post portions 31R and 32R have a U-shaped cross section, and an engagement portion 311R is bent at a substantially right angle with respect to a panel surface at a tip end portion thereof. Since the lower ends of the post portions 31R and 32R are engaged with the side surfaces of the front leg 22 and the rear leg 23 of the base panel 20, the lower ends thereof protrude from the lower end of the right side panel 30R.

In the grille portion 33, a portion extending from the lower end to the upper end of the second heat exchanger 3R is opened in a latticed shape, and the second heat exchanger 3R is adapted to be exposed to the outside via the grille portion 33. The panel portion 34 is a panel surface which closes the right side surface of the blower chamber FC and three reinforcing ribs 341 are disposed in this example.

Figure 4:
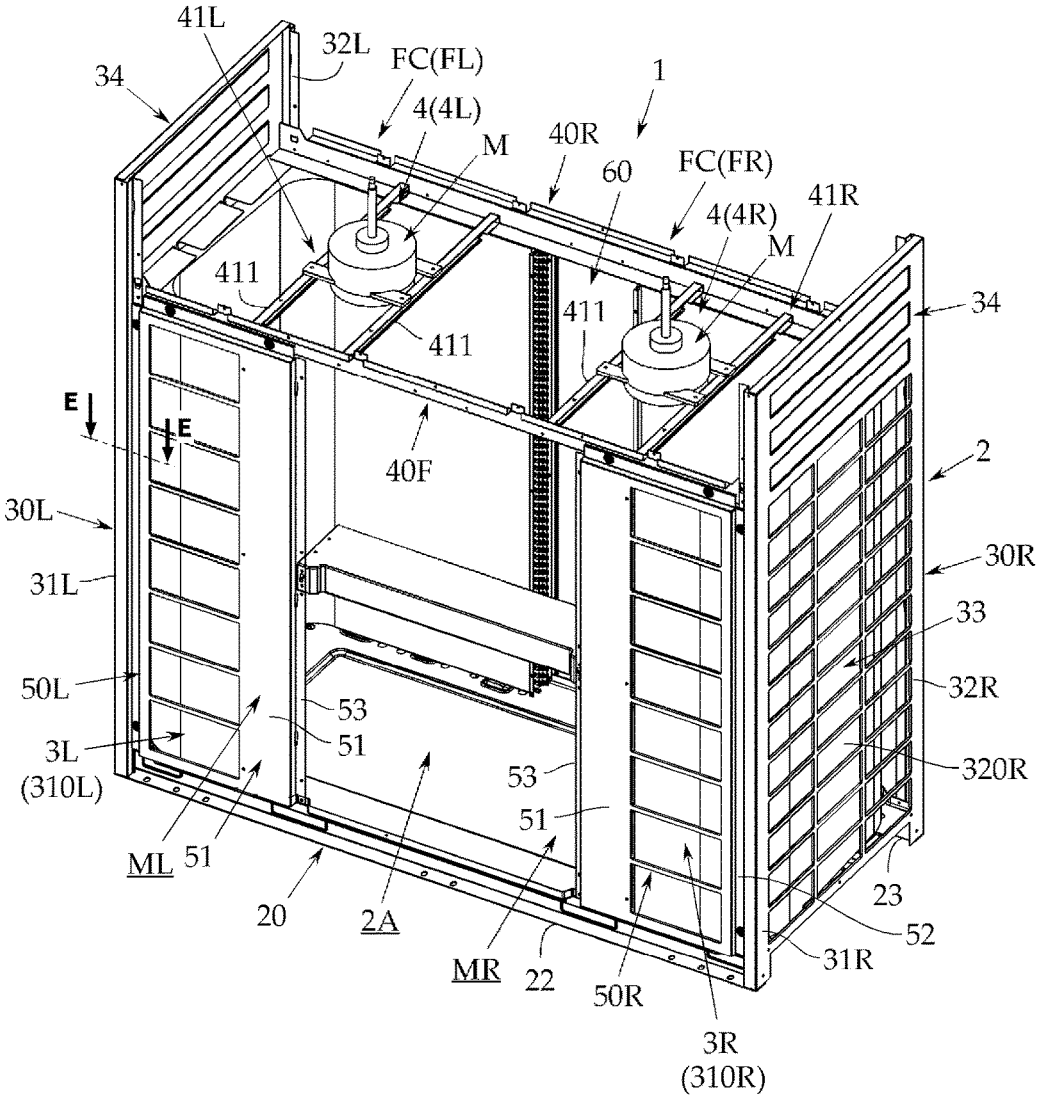
FIG. 4 is an external perspective view of a front surface side of a front pillar attached to a base panel, a front beam, and a side panel.

Referring to FIG. 4, the front beam 40F includes an angle steel material having an L-shaped cross section in this example, and is horizontally hung between the post portion 31L of the left side panel 30L and the post portion 31R of the right side panel 30R. One end of the front beam 40F is screwed to the engagement portion 311L of the post portion 31L on the front end side of the left side panel 30L, and the other end thereof is screwed to the engagement portion 311R of the post portion 31R on the front end side of the right side panel 30R.

The rear beam 40R includes an angle steel material similarly having an L-shaped cross section, and is horizontally hung between the post portion 32L of a left side panel 30L and the post portion 32R of the right side panel 30R. One end of the rear beam 40R is screwed to the engagement portion 311L of the post portion 32L on the rear end side of the left side panel 30L, and the other end thereof is screwed to the engagement portion 311R of the post portion 32R on the rear end side of the right side panel 30R.

In the embodiment, the front beam 40F and the rear beam 40R are disposed along a boundary between the machine chamber MC and the blower chamber FC of the housing 2. The front beam 40F and the rear beam 40R are disposed on the same plane so as to be parallel to each other and parallel to the base panel 20.

Referring to FIG. 4, a first motor bracket 41L that mounts the first blower 4L and a second motor bracket 41R that mounts the second blower 4R are disposed between the front beam 40F and the rear beam 40R. In the embodiment, the first motor bracket 41L is disposed in the left blower chamber FL, and the second motor bracket 41R is disposed in the right blower chamber FR.

Since the first motor bracket 41L and the second motor bracket 41R have the same configuration, hereinafter, the first motor bracket 41L will be described. The first motor bracket 41L includes a pair of beam members hung in parallel between the front beam 40F and the rear beam 40R, and both ends thereof are respectively screwed and fixed to the front beam 40F and the rear beam 40R.

A fan motor M of the blower 4L is mounted on the first motor bracket 41L, and a blower fan (not illustrated) is attached to a rotation shaft of the fan motor M. Although a bell mouth (not illustrated) is provided on an outer circumference of the blower fan, a description thereof will be omitted.

According to this configuration, since the two blowers 4L and 4R are disposed side by side horizontally on the front beam 40F and the rear beam 40R, bending moment increases from the both ends toward the center for the front beam 40F and the rear beam 40R, and there is a possibility that distortion or bending occurs in the front beam 40F and the rear beam 40R.

Therefore, in order to increase mechanical strength of the front beam 40F and the rear beam 40R, a front pillar 50 and a rear pillar 60 are disposed in the housing 2. The front pillar 50 is provided with a left front pillar 50L disposed at a front surface side of the left machine chamber ML, and a right front pillar 50R disposed at a front surface side of the right machine chamber MR.

Figure 8A:
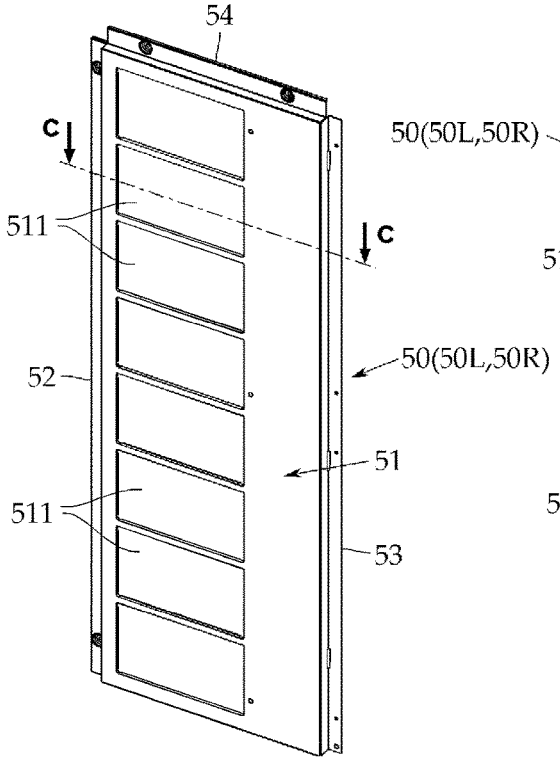
FIG. 8A is a perspective view of a front surface side of a left front pillar.
Figure 8B:
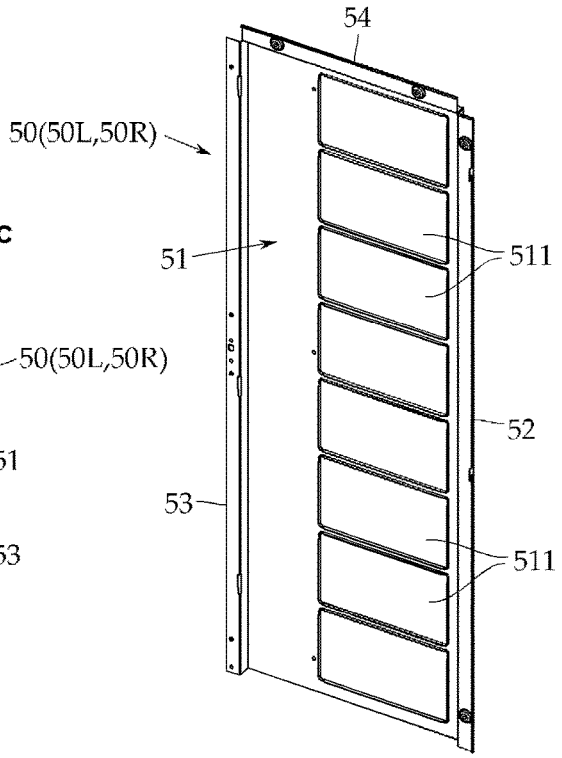
FIG. 8B is a perspective view of a rear surface side of the left front pillar.
Figure 9:
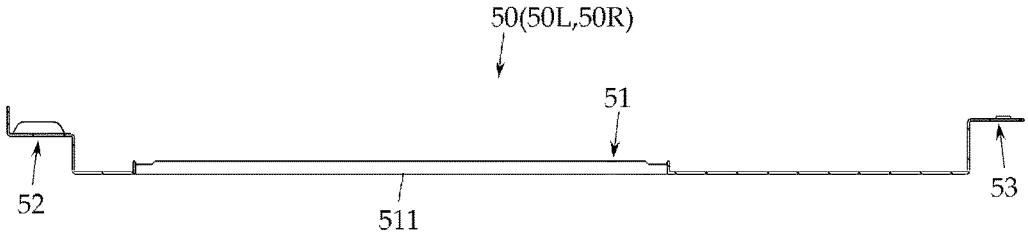
FIG. 9 is a cross-sectional view taken along line C-C of FIG. 8A.

Hereinafter, referring to FIGS. 8A, 8B, and 9, although a configuration of each of the front pillars 50L and 50R is described, since the basic configurations of the left front pillar 50L and the right front pillar 50R are the same as each other, and have a symmetrical shape, the left front pillar 50L will be described.

The left front pillar 50L includes, for example, a single press-formed steel plate, and is formed in a vertically elongated rectangular shape. The left front pillar 50L is provided with the grille portion 51 as a front suction grille for protecting the left front portion 310L of the first heat exchanger 3L and exposing the front surface side of the first heat exchanger 3L to the outside of the housing. In the embodiment, the grille portion 51 is formed in a latticed shape in which eight through holes 511 cut out squarely are disposed.

A first flange portion 52 for screwing the left front pillar 50L to the post portion 31 of the left side panel 30L is disposed at the left end of the left front pillar 50L. A second flange portion 53 to which service panels 70A and 70B and an electric component box 80 described later are attached is disposed at a right end of the left front pillar 50L. A third flange portion 54 for screwing to the front beam 40F is further disposed on the upper end of the left front pillar 50L.

Figure 12:
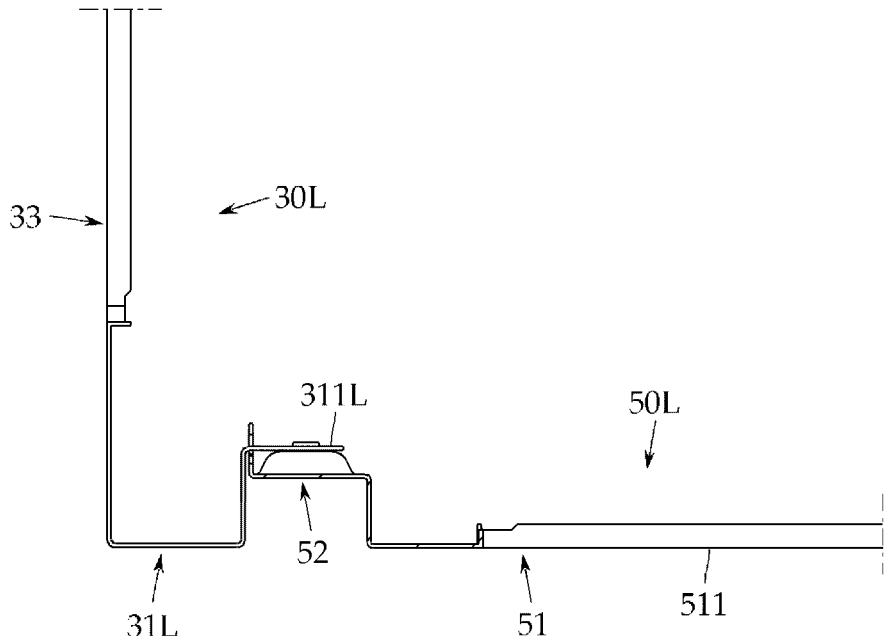
FIG. 12 is a cross-sectional view taken along line E-E of FIG. 4.

A lower end side of the left front pillar 50L is screwed to the base panel 20, and the upper end side of the left front pillar 50L is screwed to the front beam 40F via the third flange portion 54, but, as illustrated in FIG. 12, where the first flange portion 52 abuts along and is further screwed to the engagement portion 311L of the post portion 31L of the left side panel 40L.

Figure 10A:
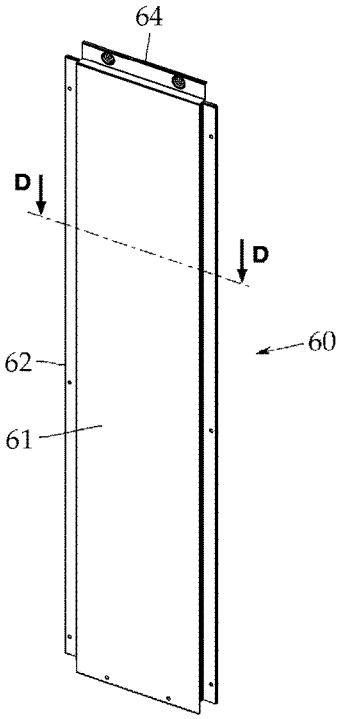
FIG. 10A is a perspective view of a front surface side of a rear pillar.
Figure 10B:
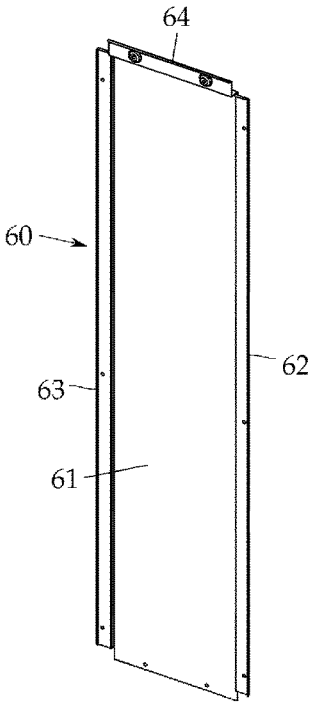
FIG. 10B is a perspective view of a rear surface side of the rear pillar.
Figure 11:
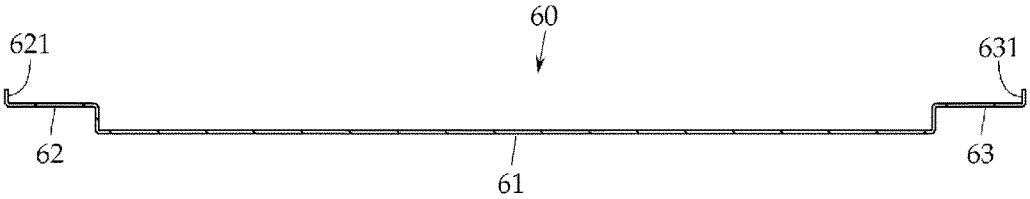
FIG. 11 is a cross-sectional view taken along line D-D of FIG. 10A.

As illustrated in FIGS. 10A and 10B, and 11, the rear pillar 60 includes, for example, a press-formed steel plate, and is formed in a vertically elongated rectangular shape in which the lower end thereof is fixed to the base panel 20, and the upper end thereof is fixed to the rear beam 40R.

The rear pillar 60 is provided with a panel body 61 on the center, that closes a rear opening portion 2B existing between the first heat exchanger 3L and the second heat exchanger 3R. The first flange portion 62 screwed to an end plate 35L of the first heat exchanger 3L is formed at the right end of the rear pillar 60 (right end in FIG. 10B), and the second flange portion 63 screwed to the end plate 35R of the second heat exchanger 3R is formed at the left end of the rear pillar 60 (left end in FIG. 10A). A third flange portion 64 screwed to the rear beam 40R is formed at the upper end of the rear pillar 60.

As illustrated in FIG. 11, the first flange portion 62 and the second flange portion 63 are formed at a position recessed by one step from the panel surface of the panel body 61. The tip end portions 621 and 631 of the first flange portion 62 and the second flange portion 63 are bent substantially at a right angle toward the inside of the housing 2.

Figure 13:
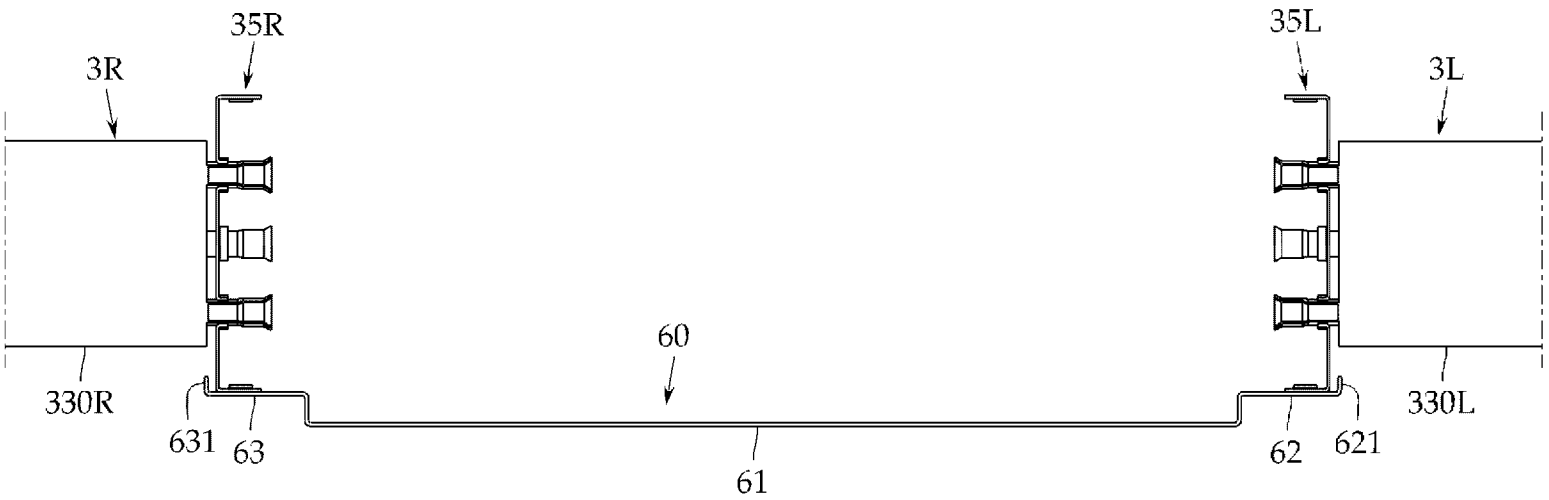
FIG. 13 is a cross-sectional view taken along line F-F of FIG. 2.

As illustrated in FIG. 13, the lower end of the rear pillar 60 is screwed to the base panel 20, the upper end of the rear pillar 60 is screwed to the rear beam 40R, the first flange portion 62 is screwed to the end plate 35L of the first heat exchanger 3L, and the second flange portion 63 is screwed to the end plate 35R of the second heat exchanger 3R. Thereby, as illustrated in FIG. 2, the rear opening portion 2B existing between the first heat exchanger 3L and the second heat exchanger 3R can be covered with the rear pillar 60.

According to this configuration, the two front pillars 50L and 50R are screwed between the base panel 20 and the front beam 40F and the rear pillar 60 is locked between the base panel 20 and the rear beam 40R. Therefore, the mechanical strength of the housing 2 is increased, and deformation and bending of the housing 2 can be prevented.

Although protection grilles (not illustrated) for respectively protecting a rear portion 330L of the first heat exchanger 3L and a rear portion 330R of the second heat exchanger 3R are screwed between the rear pillar 60 and the right and left side panels 50R and 50L, since a description is particularly not required in the present invention, the description thereof will be omitted.

Referring to FIGS. 1 to 4, the space between the left front pillar 50L and the right front pillar 50R of the housing 2 is a front opening portion 2A (refer to FIG. 4) for maintenance. Accordingly, the service panel 70 is attached to the front opening portion 2A.

The service panel 70 includes two panel materials having an upper service panel 70A that closes an upper side of the front opening portion 2A, and a lower service panel 70B that closes a lower side of the front opening portion 2A.

The upper service panel 70A and the lower service panel 70B include substantially square metal panels. The left end (left end in FIG. 1) of the upper service panel 70A and the lower service panel 70B is provided with a first locking flange 71 screwed to the second flange portion 53 of the left front pillar 50L. The right end (right end in FIG. 1) of the upper service panel 70A and the lower service panel 70B is provided with a second locking flange 72 screwed to the second flange portion 53 of the right front pillar 50R.

In the embodiment, the lower left corner of the lower service panel 70B is cut in an L shape to configure a cutout portion 73. A conduit panel 74 for connecting a conduit pipe (not illustrated) is fitted into the cutout portion 73.

As illustrated in FIG. 3, the electric component box 80 is disposed on a rear surface (surface facing the inside of the housing 2) of the upper service panel 70A. The electric component box 80 includes a rectangular parallelepiped box substantially equal in size to the upper service panel 70A and is screwed to the second flange portions 53 and 53 of the right and left front pillars 50R and 50L.

The front panel 90F is disposed at a front surface side (front surface side in FIG. 1) of the blower chamber FC, and a rear panel 90R is disposed at a rear surface side (front surface side in FIG. 2) of the blower chamber FC of the housing 2. Both the front panel 90F and the rear panel 90R are horizontally elongated rectangular metal panels covering the front surface side and the rear surface side of the blower chamber FC, and are respectively screwed to the side panels 30L and 30R.

A top panel 91 is attached to a top surface of the blower chamber FC. A top panel 91 includes a horizontally elongated rectangular metal frame covering the upper surface of the housing 2, and a rectangular first opening portion 92L exposing the first air blowing port 11L and a square second opening portion 92R exposing the second air blowing port 11R are formed. In the embodiment, reinforcing beam portions 94 are formed between each of the opening portions 92L and 92R, and the protection grilles 93R and 93L are respectively screwed to each of the right and left opening portions 92R and 92L with the beam portion 94 interposed therebetween.

As described above, according to the present invention, the left front pillar 50L is fixed between the front beam 40F on the front surface side of the first heat exchanger 3L and the base panel 20, the right front pillar 50R is fixed between the front beam 40F on the front surface side of the second heat exchanger 3R and the base panel 20, and the rear pillar 60 for closing the rear opening portion 2B formed between the rear end portions 35L and 35R of the rear surface side of the first heat exchanger 3L and the second heat exchanger 3R is further fixed between the rear beam 40R and the base panel 20. Therefore, the right front pillar 50R and the left front pillar 50L serve as supports for reinforcing the front beam 40F, the rear pillar 60 serves as a support for reinforcing the rear beam 40R, and thus it is possible to prevent the front beam 40F and the rear beam 40R from being distorted or bent. As a result, the mechanical strength of the entire housing can be enhanced, and the assembly stability is improved.

In addition, since grills of the latticed shape are integrally formed on the left and right front pillars 50L and 50R, it is no longer required to prepare the protection grille and the like separately, and it is possible to reduce the protection grille and screws for fixing.

What is claimed is:

1. An outdoor unit of an air conditioner comprising:

a housing that includes a base panel, a left side panel and a right side panel disposed along a left side end and a right side end of the base panel, respectively, a front beam hung between front ends of the left side panel and the right side panel, and a rear beam hung between rear ends of the left side panel and the right side panel, and further includes a blower chamber having first and second blowers supported side by side by the front beam and the rear beam at an upper portion of the housing, and a machine chamber having a first heat exchanger, a second heat exchanger, and a compressor at a lower portion of the housing, the lower portion being partitioned from the upper portion with a plane including the front beam and the rear beam as a boundary, the first heat exchanger housed on a first blower side defined as a left machine chamber, the second heat exchanger housed on a second blower side defined as a right machine chamber;

an air blowing port of the first and second blowers disposed on a top surface of the housing;

a front pillar for supporting an intermediate portion of the front beam, disposed between a front end of the base panel and the front beam, and including a left front pillar disposed on a front surface of the left machine chamber and integrally formed with a front suction grille for exposing a front surface side of the first heat exchanger to outside of the housing, a left end of the left front pillar being fixed along the front end of the left side panel, and a right front pillar disposed on a front surface of the right machine chamber and integrally formed with a front suction grille for exposing a front surface side of the second heat exchanger to the outside of the housing, a right end of the right front pillar being fixed along the front end of the right side panel; and a rear pillar for supporting an intermediate portion of the rear beam, disposed between a rear end of the base panel and the rear beam, wherein each of the first and second heat exchangers includes a front portion disposed along the front end of the base panel, a side portion disposed along the corresponding left or right side end of the base panel, and a rear portion disposed along the rear end of the base panel, to have a U-shape, end portions of the first heat exchanger and the second heat exchanger being disposed so as to face each other.

2. The outdoor unit of the air conditioner according to claim 1, wherein the rear pillar is disposed at a position to close a rear opening portion existing between a rear end portion of the first heat exchanger and a rear end portion of the second heat exchanger.

3. The outdoor unit of the air conditioner according to claim 1, wherein the left side panel includes a pair of post portions engaged with corner portions of the left side end of the base panel, respectively, and a side suction grille formed between the pair of post portions for exposing the side portion of the first heat exchanger to the outside of the housing, and the right side panel includes a pair of post portions engaged with corner portions of the right side end of the base panel, respectively, and a side suction grille formed between the pair of post portions of the right side panel for exposing the side portion of the second heat exchanger to the outside of the housing.

4. The outdoor unit of the air conditioner according to claim 1, wherein a front opening portion for maintenance exists between the left front pillar and the right front pillar, and a service panel for closing the front opening portion is disposed between the left front pillar and the right front pillar.

5. The outdoor unit of the air conditioner according to claim 4, wherein the left front pillar and the right front pillar are disposed between the front end of the base panel and the front beam to support the front beam.

6. The outdoor unit of the air conditioner according to claim 5, further comprising one front panel disposed between the front beam and the top surface of the housing and connecting the left side panel and the right side panel for covering a front surface side of the blower chamber, wherein the service panel is disposed between the front beam and the base panel, and includes an upper service panel covering an upper side of the front opening portion, and a lower service panel arranged between the upper service panel and the base panel and covering a lower side of the front opening portion.

7. The outdoor unit of the air conditioner according to claim 6, further comprising an electric component box disposed on a rear surface of the upper service panel and between front end portions of the first and second heat exchangers, the electric component box being connected to the right and left front pillars.

* * * * *